United States Patent [19]

Yudovich et al.

[11] Patent Number: 4,591,362

[45] Date of Patent: May 27, 1986

[54] FLUID INJECTION METHOD

[75] Inventors: Amos Yudovich, Tulsa; George E. Hays, Bartlesville, both of Okla.

[73] Assignee: Phillips Petroleum Company, Bartlesville, Okla.

[21] Appl. No.: 597,289

[22] Filed: Apr. 6, 1984

[51] Int. Cl.[4] ..... C10J 3/60

[52] U.S. Cl. ..... 48/197 R; 48/202; 48/203; 201/33

[58] Field of Search ..... 48/197 R, 202, 203, 48/206, 210, 214 R, 215, 209; 201/33, 38

[56] References Cited

U.S. PATENT DOCUMENTS

| | | | |
|---|---|---|---|
| 545,973 | 9/1895 | Purves | 48/73 |
| 849,947 | 4/1907 | Wagner | 202/218 |
| 1,159,675 | 11/1915 | Hornsey | 48/202 |
| 3,794,483 | 2/1974 | Rossi | 75/91 |
| 3,990,865 | 11/1976 | Cybriwsky et al. | 48/197 R |
| 4,159,306 | 6/1979 | Borst | 422/210 |
| 4,273,619 | 6/1981 | Angelo | 202/211 |

*Primary Examiner*—Jay H. Woo
*Assistant Examiner*—Joye L. Woodard
*Attorney, Agent, or Firm*—A. W. Umphlett

[57] ABSTRACT

A process for gasifying carbonaceous solids in a rotating zone is disclosed wherein the gasifying agents are injected into a tumbling bed of the solids through an elongated, rotating tubular flow path (19) positioned and supported so as to remain in the tumbling bed during rotation of the zone. The invention is particularly useful in rotary kilns where coal, lignite, peat, heavy oil residual, and other carbonaceous materials are gasified using injected steam, oxygen or air.

4 Claims, 5 Drawing Figures

FLUID INJECTION METHOD

This invention relates to a method of introducing fluids into a rotating zone. It also relates to an apparatus for introducing fluids into a rotating zone.

BACKGROUND OF THE INVENTION

A coal gasification process utilizing a rotary kiln is described in U.S. Pat. No. 3,990,865 wherein steam or other fluids are admitted into the kiln through a series of circumferentially spaced longitudinally extending passageways and then through radially directed ports in the kiln wall. A complex control system is required to activate the appropriate valves so that the fluids are only admitted to those ports that are directly beneath the coal bed. Because of the higher temperature near the ports, ash melting over the ports forms a slag "dome" over the ports. This slag dome will eventually plug the ports, thus reducing the rate of gasification. This problem is more severe when oxygen is injected because of the resulting higher temperature at the port outlets.

The present invention provides a simplified method of admitting fluid to a rotary zone. It further provides an apparatus that can be removed and cleaned of slag build-up easily.

Therefore, an object of this invention is to provide a simplified method of injecting fluids into a rotating zone.

Another object is to provide an apparatus for injecting fluids into a rotating zone.

Another object of this invention is to provide an apparatus that can easily be pulled out of the rotating zone for cleaning of the slag dome build-up.

Other objects will become apparent from the following description of the invention.

SUMMARY OF THE INVENTION

The instant invention provides a new method and apparatus for injecting fluid into a rotating zone. In the preferred embodiment, the fluid is injected into a rotary kiln. The rotating zone or kiln is provided with one or more elongated tubular flow paths that are supported in the rotating zone. In the preferred embodiment, the elongated tubular flow paths are tubes supported by concentric rings attached to the kiln wall. The tubes are provided with outlets to allow injection of fluids into the rotating zone or kiln. The tube rotates at the same tangential velocity as the rings so that there is no friction between the tube and rotating rings. The tube is also provided with a coupling means so that the tube can be removed for maintenance or repair. In another aspect, the tube has a double wall so that a heat exchange fluid can be passed through the tube for cooling purposes.

DETAILED DESCRIPTION OF THE DRAWINGS

DESCRIPTION OF THE INVENTION

For illustration purposes, coal will be used as the material charged into this rotating zone. However, any carbonaceous material, such as lignite, peat or heavy oil residual may be used.

This invention can be used with any rotating zone in which fluid is to be injected. In the preferred embodiment of this invention, the rotating zone is a rotary kiln.

Figure 1:
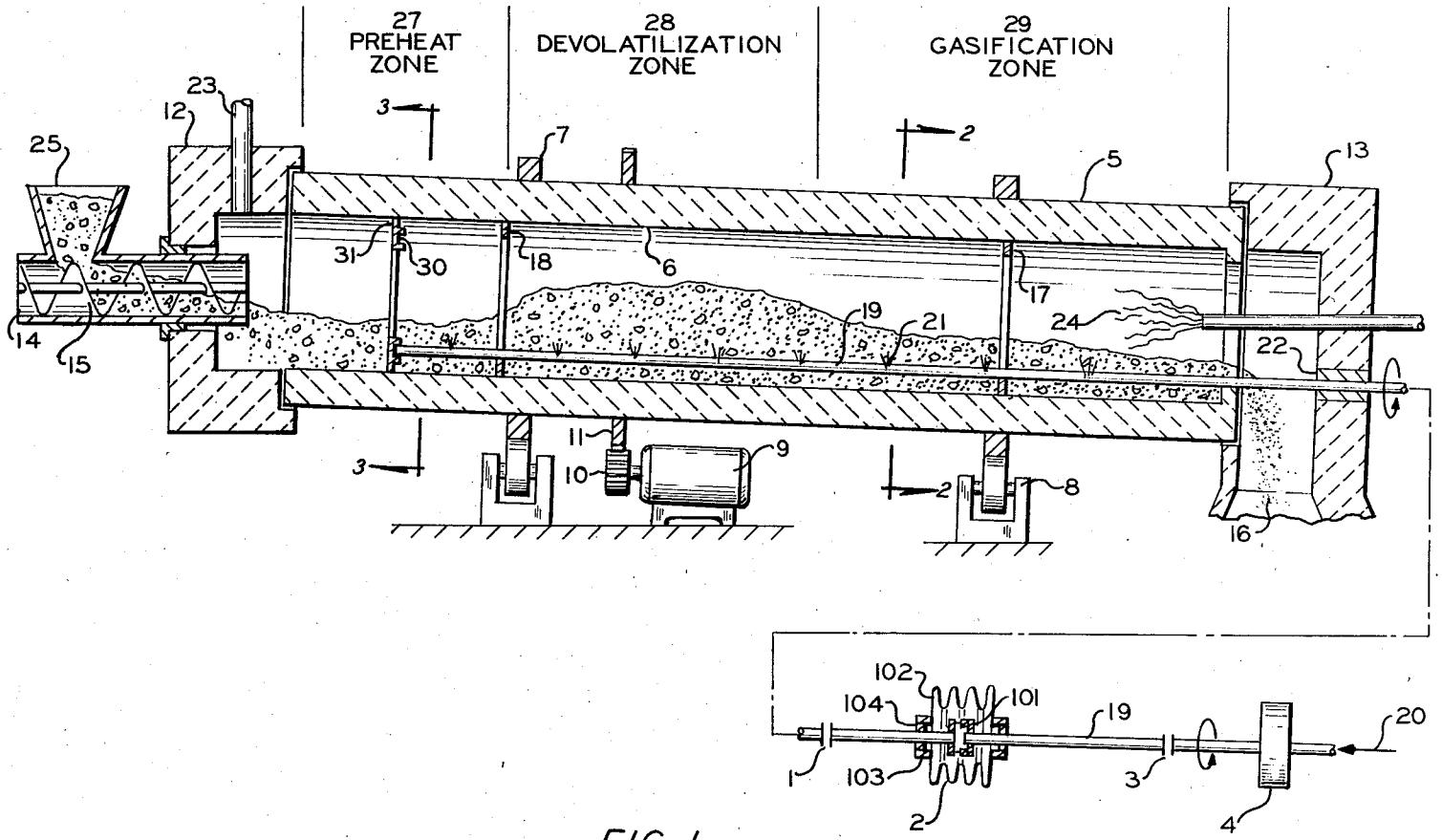
FIG. 1 is a side view of an example of a rotary kiln gasifier showing one embodiment of the apparatus for injecting fluid.

Referring to FIG. 1, the kiln is provided with a long cylindrical body portion 5 which contains the cylindrical chamber.

The walls of this chamber 6 can be made of any suitable fire resistant material such as firebrick. Any means can be provided to support the kiln. This example provides annular girth rings 7 that are spaced along the outer periphery of the kiln body. These annular rings are supported on wheels 8 that are contained in conventional bearings to allow rotation. The rotation is controlled by a motor 9 which is provided with a drive gear 10 meshed with a girth gear 11 connected to the kiln body. Any conventional rotation means can be provided.

A stationary piece 12 is provided at the intake end of the kiln as well as at the discharge end 13 of the kiln. The stationary piece at the intake end of the kiln can be provided with a feed hopper 14 that extends into the kiln to provide a continuous charge of carbonaceous material to the kiln chamber. Here, for purposes of illustration, the hopper is provided with a screw 15 for conveying the coal to the kiln. The stationary piece at the discharge end of the kiln is provided with an opening 16 aligned with the kiln chamber 6 so that unreacted coal ash can pass from the cylinder.

Both of these end pieces, the discharge 13 and the intake 12 end, are stationary and the kiln rotates relative to these pieces. The end pieces can be flanged and any necessary seals of any conventional type can be used.

The interior to the kiln chamber can contain a ring or rings (FIG. 2) 17, of a lesser diameter than the chamber wall, positioned concentrically within the chamber. The ring is attached to the chamber in any suitable manner 18. The ring (or rings) 17 support a tube 19 that runs along the length of the kiln chamber 6 and extends through the stationary discharge end piece 13. The tube is supported at the other end by a circular cap 30 attached to the kiln wall 31. This tube 19 can be supported in the chamber in any other suitable manner. The tube is positioned in the lower half of the kiln chamber within the bed of coal or other carbonaceous material. The tube can be connected to a source of water, air, oxygen or steam or any other fluid 20.

The tube can contain several outlets 21 along its length at various intervals. These outlets can be nozzles or punctures of any size or dimension, or of various sizes and dimensions. This invention is not limited by the type, size, position or number of outlets in the tube. Other parallel tubes can also be used in the scope of this invention to provide air, oxygen or other fluids to the kiln.

In another embodiment, the tubes can be concentric, of different lengths so that they extend to different depths into the kiln. If more than one tube is present, they should be different lengths. This enables one to provide different amounts of fluids to different regions of the kiln.

The stationary discharge end piece 13 is provided with bearings 22 to allow the tube that extends through the piece to rotate.

The tube can be provided with one or more couple means, 1 and 3 outside the kiln chamber for disconnecting the tube from the fluid supply means. Once disconnected, the tube 19 can be removed from the kiln for cleaning or replacement.

The tube can be further connected to a bellows type coupling means 2. This bellows type coupling means provides for greater flexibility of the tube means during the rotation of the tube and kiln. The bellows type coupling means can be of any conventional means. For illustration purposes, the bellows coupling is a universal joint 101 enclosed in a bellows 102 which is clamped 103 and sealed 104 in a conventional manner to the tube 19.

The tube can be further connected to a drive or bearing means 4 outside the kiln. This drive or bearing means allows the supply lines to remain stationary while the tube rotates. The drive or bearing means 4 can be any conventional drive or bearing means.

The tube can be made of any conventional material depending upon the type of rotating zone. If the rotating zone is a rotating kiln, the tube, preferably, will be made of high-temperature alloys, especially alloys containing chromium, such as the austenitic stainless steels.

The tube can also be a double wall tube so that the tube can be cooled by water or other fluid running through the tube. This is done to cool the injection ports to prevent excessive slag build-up. Another method for cooling the injection ports is to mix water or wet steam with the oxidant gases (air or oxygen). The water will evaporate at the injection ports thus lowering their temperature.

The tube can be of any diameter or thickness suitable to its use. The tube diameter depends on the flow-rate of the steam and oxidant gases injected into the kiln.

In operation the kiln is rotated by the motor and at the same time preheated to the desired temperature by the burner flame 24.

Figure 2:
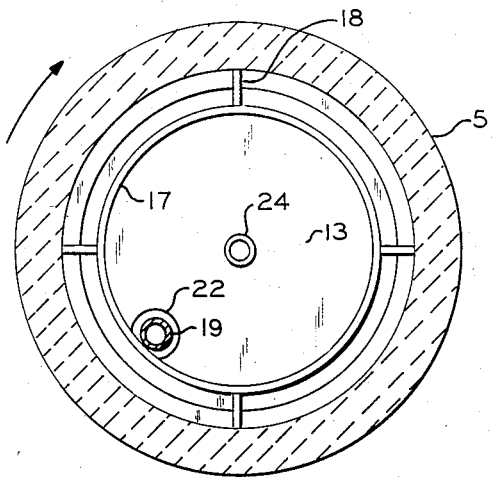
FIG. 2 is a cross-section taken along 2—2 showing an embodiment of the supporting means for the fluid injecting apparatus.
Figure 3:
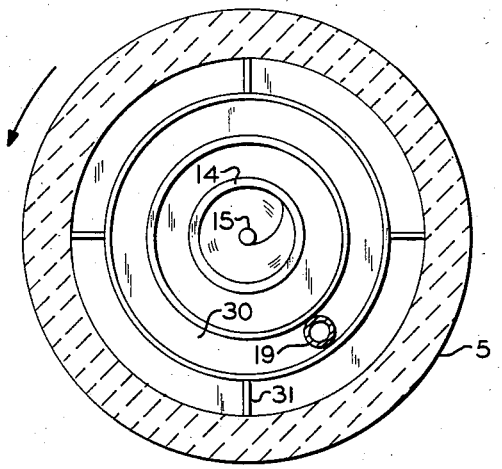
FIG. 3 is a cross-section taken along 3—3 showing one embodiment of the end supporting means.
Figure 4:
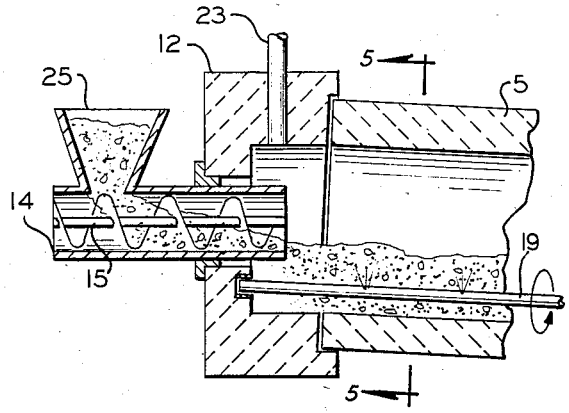
FIG. 4 shows a second embodiment of the end supporting means.
Figure 5:
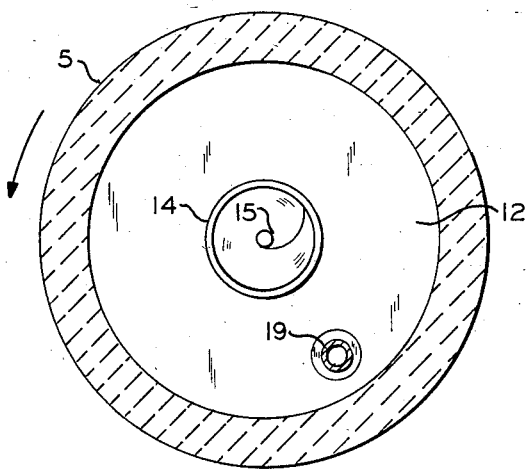
FIG. 5 is a cross-section taken along 5—5 showing the end supporting means of FIG. 4.

When the kiln has reached the desired temperature, the charge of coal is fed into the kiln through the opening 25 in the feed hopper 14. As the kiln 5 rotates, the inside ring 17 rotates. The tube 19 also rotates at the same tangential velocity as the ring 17, thereby maintaining its position relative to the ring, without any friction between the tube and the moving ring. As the coal is delivered from the hopper 14 to the rotating kiln chamber, the coal moves to the left quadrant due to the motion of the rotating kiln chamber as shown in FIG. 2. The material also moves towards end piece 13 due to the slight elevation of the intake side 12. The tube 19 is positioned inside the moving coal bed throughout the length of the kiln chamber. Air, oxygen, steam or other gasifying agents are admitted through the outlets 21 in the tube 19. As the coal is gasified, the off-gas or product gas flows to the left and out the product gas discharge 23. After the kiln has been loaded and the gasification temperature has been reached, the flame can be extinguished as the process temperature is substantially self-sustaining. The hot product gases flowing over the devolatilization 28 and preheat 27 zones transfer heat to the coal bed and cause the coal temperature to increase.

In the preheat zone 27, the temperature of the bed is increased by the off-gas passing above the bed to about 600° F., depending on the type of material utilized in the bed. The purpose of the preheat zone is to provide a transition temperature range in which any moisture remaining in the coal or carbonaceous material is driven off. The material is caused to move through the preheat zone at a rate so that it reaches the vicinity of the devolatilization zone 28 before it has reached the agglomerating temperature for the particular carbonaceous material being processed. Since the amount of agglomeration is dependent on the time the material remains in the agglomerating temperature range, it is important to cause the carbonaceous material to agglomerate in that zone of the kiln where the temperature of the material can be controlled. Since the devolatilization zone 28 is provided with tube outlets 21, the residence time of the material in the agglomerating temperature range can be quite precisely controlled in this zone of the kiln. Therefore, if the material is caused to attain both the agglomerating and non-agglomerating temperatures substantially within the devolatilizing zone, the number and size of the agglomerates can be effectively controlled.

The devolatization onset temperature is dependent on the type of material involved, but it is in the neighborhood of 600° F.–800° F. for most coals. Once the material reaches this temperature, it becomes semi-plastic and begins to agglomerate. Sufficient hot gas, steam, or combustion air is admitted through the tube outlets 21 in the devolatilization zone to quickly raise the temperature of the material to that temperature at which the particular material being processed no longer exhibits a tendency to agglomerate. It has been determined that most agglomerated coal will begin to break up upon sufficient rotation in the rotary kiln if its temperature is raised to and maintained at or above a temperature of approximately 1600° F. Most coals will pass through the semi-plastic state between the temperatures of 600° F.–1600° F. which can be referred to as the agglomerating temperature range. The time of raising the temperature of the coal from the beginning to the semi-plastic state (the agglomerating temperature), to the temperature at which the agglomerates begin to break down (the non-agglomerating temperature), is controlled by the amount of air or oxygen emitted through the tube outlets in the devolatilization zone. The coal temperature must be increased to a non-agglomerating temperature of the particular coal being processed before the agglomerates grow to sufficient size and number to adversely affect proper material flow through the kiln.

Once the carbonaceous material has reached the non-agglomerating temperature, it is in the vicinity of the gasification zone 29. Additional air or steam is admitted through the outlets 21 to effect gasification. The controlled agglomerates are broken up due to the temperature and tumbling action of the bed. The carbonaceous material is caused to remain in a gasification zone until the agglomerates have broken down and substantially complete gasification has occurred.

The embodiments of the invention in which the exclusive privileges are claimed are as follows.

1. A process for gasifying solid carbonaceous material to yield gaseous products and solid residue comprising:

(1) introducing said carbonaceous material into an elongated, inclined rotating zone thereby forming a tumbling bed of said material, (2) injecting a gasifying agent into said tumbling bed through outlets in an elongated, tubular flow path positioned and supported to remain in said tumbling bed by means attached to and rotating with said zone, (3) maintaining said position of the tubular flow path relative to the rotating means of support by rotating the tubular flow path along said support means at a velocity such that no friction occurs therebetween, (4) maintaining said tumbling bed at a temperature sufficient to produce gasified products from said carbonaceous material, (5) recovering said gaseous products, and (6) discharging said residue from said rotating zone.

2. A process as in claim 1 where said material is at least one of coal, lignite, peat, and heavy oil residue.

3. A process according to claim 1 where said gasifying agent is at least one of steam, air and oxygen.

4. A process according to claim 1 wherein there are multiple tubular flow paths for injecting said gasifying agent into said zone.

* * * * *